US007293536B2

(12) United States Patent
Yuasa

(10) Patent No.: US 7,293,536 B2
(45) Date of Patent: Nov. 13, 2007

(54) TWO-CYCLE COMBUSTION ENGINE

(75) Inventor: Tsuneyoshi Yuasa, Kobe (JP)

(73) Assignee: Kawasaki Jukogyo Kabushiki Kaisha, Kobe-Shi (JP)

( * ) Notice: Subject to any disclaimer, the term of this patent is extended or adjusted under 35 U.S.C. 154(b) by 0 days.

(21) Appl. No.: 11/605,595

(22) Filed: Nov. 28, 2006

(65) Prior Publication Data

US 2007/0119396 A1 May 31, 2007

(30) Foreign Application Priority Data

Nov. 29, 2005 (JP) ..... 2005-343512

(51) Int. Cl.
*F02B 33/04* (2006.01)
*F02B 25/00* (2006.01)

(52) U.S. Cl. ..... 123/73 PP; 123/73 R; 123/73 A

(58) Field of Classification Search ..... 123/73 PP, 123/73 A, 73 R, 74 R, 65 P, 65 A, 65 R
See application file for complete search history.

(56) References Cited

U.S. PATENT DOCUMENTS

2003/0226526 A1* 12/2003 Rosskamp et al. ..... 123/73 PP
2004/0237914 A1* 12/2004 Watkins et al. ..... 123/73 PP

FOREIGN PATENT DOCUMENTS

JP 58-43616 UY 10/1993
JP 2000-170538 A * 6/2000

* cited by examiner

*Primary Examiner*—Stephen K. Cronin
*Assistant Examiner*—Ka Chun Leung

(57) ABSTRACT

To provide a two cycle combustion engine provided with scavenging passages of a structure, which is effective to minimize a deposit of fuel contained in an air/fuel mixture and allows the mixture to be injected into a combustion chamber so as to avoid the blow-off of the air/fuel mixture, the engine includes a cylinder block 1 having a cylinder bore 1*a*, a scavenging-passage-defining wall member 34 made separate from the cylinder block 1 and fitted to the cylinder block 1. A scavenge regulating segment 37, 38 secured to the scavenging-passage-defining wall member 34 is spaced from an outer diametric surface 24C, 27C of the scavenging passage 24, 27 and two side surfaces 24A, 24B or 27A, 27B of the scavenging passage 24, 27 that are opposed to each other in a direction circumferentially of the cylinder bore 1*a* and occupies a circumferential center portion of the scavenging passage 24, 27.

5 Claims, 7 Drawing Sheets

TWO-CYCLE COMBUSTION ENGINE

BACKGROUND OF THE INVENTION

1. Field of the Invention

The present invention relates generally to a small-size two cycle combustion engine of a kind mainly used as a drive source for a work machine or equipment such as, for example, a brush cutter.

2. Description of the Prior Art

Two cycle combustion engines of the kind referred to above conventionally have scavenging passages for supplying an air/fuel mixture into the engine combustion chamber. In those two cycle combustion engines, the scavenging passages are formed in an engine cylinder block simultaneously with casting of the engine cylinder block. Formation of respective scavenging ports at downstream ends of the scavenging passages has hitherto required the use of a slide die slidable in a direction radially of the cylinder block, thus rendering the die assembly to be complicated and costly.

In order to alleviate the foregoing problems, Japanese Examined Utility Model Publication No. 58-43616, for example, discloses the use of scavenging-passage-defining wall members separate from the engine cylinder block, but incorporated in the cylinder block to define the scavenging passages. Specifically, the scavenging-passage-defining wall members have their opposite side edges inserted from below into corresponding engagement grooves, which are defined in the cylinder block so as to extend in a direction parallel to the cylinder axis, i.e., the longitudinal axis of the cylinder bore in the cylinder block and are then fixed in position to define the respective scavenging passages partitioned from the cylinder bore.

However, considering that in the two cycle combustion engine of the conventional type referred to above, an air/fuel mixture within the crankcase, which contains air and fuel mixed still insufficiently, is introduced into the scavenging passages during the scavenging stroke, fuel contained in the air/fuel mixture is apt to deposit on inner surfaces of the scavenging passages during the flow of the air/fuel mixture through the scavenging passages to thereby form layers of fuel pitch. Once the layers of fuel pitch so deposited come to have a substantial thickness, they may depart from the inner surfaces of the scavenging passages to form fuel droplets, which are subsequently introduced into the combustion chamber. Accordingly, the fuel mixed insufficiently with the air, which is so introduced into the combustion chamber, will be eventually burned and this leads to reduction in combustion efficiency. Also, it may occur that since the air/fuel mixture introduced into the combustion chamber through the scavenging ports is not sufficiently and satisfactorily controlled in direction of flow towards the combustion chamber, the blow-off of the air/fuel mixture cannot be suppressed effectively.

On the other hand, the two cycle combustion engine disclosed in the above mentioned prior art document is found to be advantageous in that the cost of manufacture thereof can be reduced, but has a problem associated with the use of the scavenging-passage-defining wall members that are made of the same material as that of the cylinder block, for example, an aluminum alloy or spring steel, and separate from the cylinder block. Specifically, since those scavenging-passage-defining wall members are fixed in position solely by means including the engagement grooves defined in the cylinder block for receiving therein the opposite side edges of the scavenging-passage-defining wall members, one or some of the scavenging-passage-defining wall members may accidentally fall or depart downwards from the associated engagement grooves at the time the cylinder block is connected with the crankcase, resulting in a possible reduction of the assemblability of the combustion engine.

SUMMARY OF THE INVENTION

In view of the foregoing, the present invention is intended to provide a two cycle combustion engine provided with the scavenging passages of a structure, which can be formed by the use of a simplified die assembly and is effective to minimize or substantially eliminate an undesirable deposit of fuel contained in the air/fuel mixture, while allowing the air/fuel mixture to be injected into the combustion chamber in such a manner as to effectively avoid the blow-off of the air/fuel mixture.

In order to accomplish the foregoing object of the present invention, there is, in accordance with the present invention, provided a two cycle combustion engine which includes a cylinder block having a cylinder bore defined therein, a scavenging-passage-defining wall member made separate from the cylinder block and fitted to the cylinder block to form an inner diametric wall of a scavenging passage. The scavenging-passage-defining wall member is provided with a scavenge regulating segment spaced from an outer diametric surface of the scavenging passage and two opposed side surface of the scavenging passage that are opposed to each other in a direction circumferentially of the cylinder bore. The scavenge regulating segment so secured to the scavenging-passage-defining wall member occupies a circumferential center portion of an inner-diametric-wall side of the scavenging passage.

According to the present invention, since the scavenging-passage-defining wall member, which is a member separate from the cylinder block and is fitted to the cylinder block, is employed, the die assembly used to form the cylinder block may be of a structure including no slide die and, therefore, the cost of manufacture can be reduced.

Also, since the scavenging-passage-defining wall member is provided with the scavenge regulating segment that is spaced from an outer diametric surface and two inner side surfaces of the scavenging passage, and occupying a circumferential center portion on an inner diametric side of the scavenging passage, the cross-sectional areas of the scavenging passage is reduced locally to allow the air/fuel mixture flowing around the scavenge regulating segment to flow at an increased velocity and also to allow the flow of the air/fuel mixture to be concentrated in a region proximate to the outer diametric surface and two inner side surfaces of the scavenging passage. Because of the flow of the air/fuel mixture at the increased velocity, an undesirable deposit of fuel contained in the air/fuel mixture on the outer diametric surface and inner side surfaces of the scavenging passage can be suppressed, thereby avoiding an undesirable reduction of the combustion efficiency, which would otherwise result from introduction of the fuel into the combustion chamber in the form of fuel droplets.

In addition, since the air/fuel mixture flows along the two inner side surfaces of the scavenging passage, the air/fuel mixture is injected into the combustion chamber through the scavenging port in a predetermined direction along the two inner side surfaces of the scavenging passage and, therefore, the blow-off of the air/fuel mixture through the exhaust port can be effectively avoided by setting such direction properly.

Furthermore, since the scavenge regulating segment can easily be provided in the scavenging-passage-defining wall member which is the member separate from the cylinder block, increase of the cost of manufacture can be suppressed.

In a preferred embodiment of the present invention, each of the scavenging-passage-defining wall member and the scavenge regulating segment is made of a plate member. This is particularly advantageous in that the scavenging-passage-defining wall member and the scavenge regulating segment can be formed inexpensively. It is to be noted that the scavenge regulating segment may be secured to the scavenging passage by, for example, a welding technique.

In another preferred embodiment of the present invention, the cylinder block is formed with engagement grooves open axially downwardly of the cylinder block and the scavenging-passage-defining wall member is inserted at its opposite side portions within the respective engagement grooves. The scavenging-passage-defining wall member so inserted may be retained in position by a retaining member, fitted to the cylinder block, so that the scavenging-passage-defining wall member is not detached from the engagement grooves. According to this structural feature, while the scavenging-passage-defining wall member inserted in the engagement grooves from an opening below those engagement grooves may depart from the cylinder block, this departure can be advantageously barred by the retaining member, thereby increasing the assemblability of the combustion engine.

In a further preferred embodiment of the present invention, a plurality of the scavenging passages are closely juxtaposed to each other in a direction circumferentially of the cylinder block and a plurality of the scavenge regulating segments are provided for the single scavenging passage defining wall and positioned one by one inside each of the scavenging passage. This allows the use of the only one scavenging-passage-defining wall member for the plurality of scavenging passages and, therefore, the structure can be simplified advantageously.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
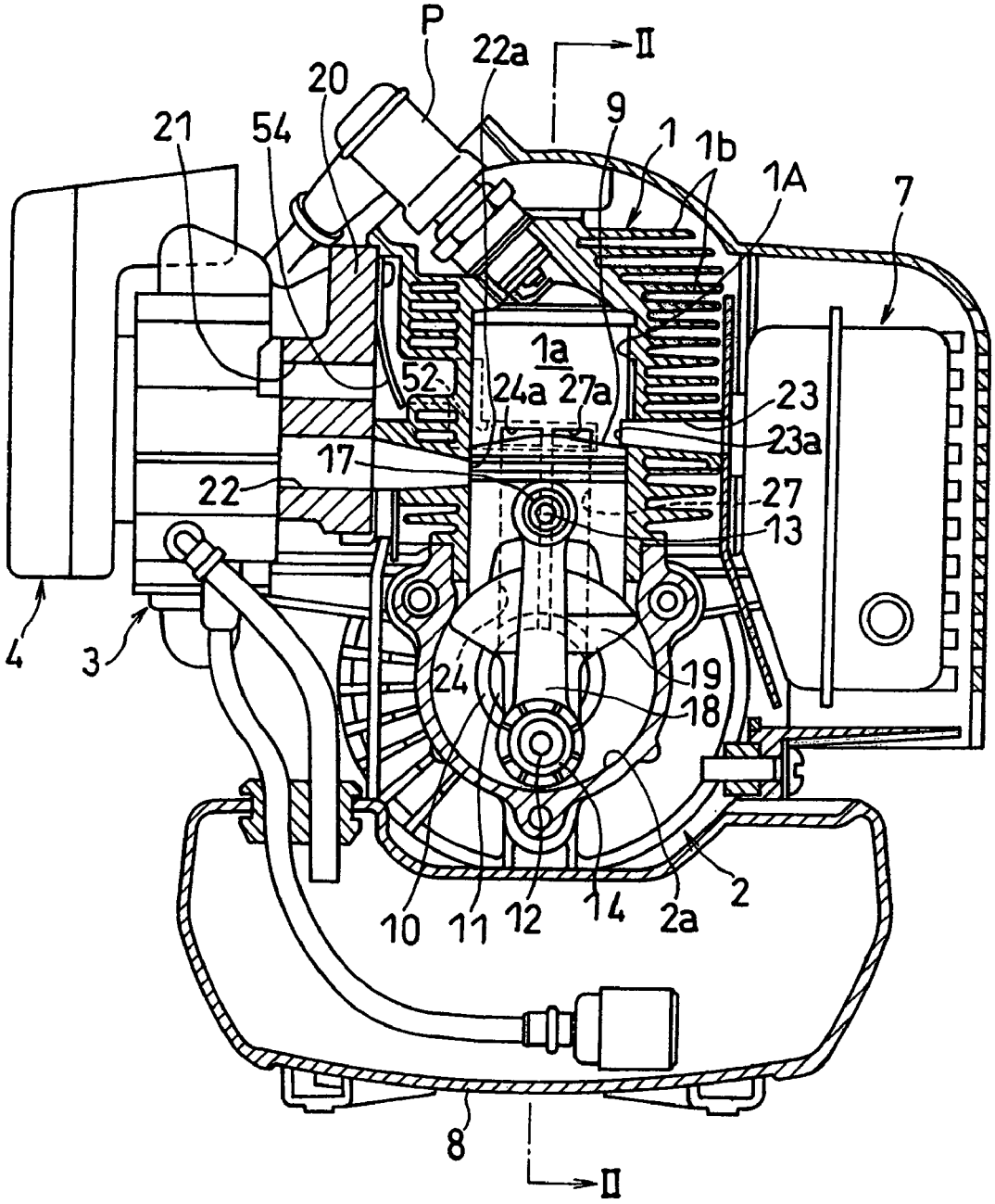
FIG. 1 is a traverse cross-sectional view of a two cycle combustion engine according to a preferred embodiment of the present invention.
Figure 2:
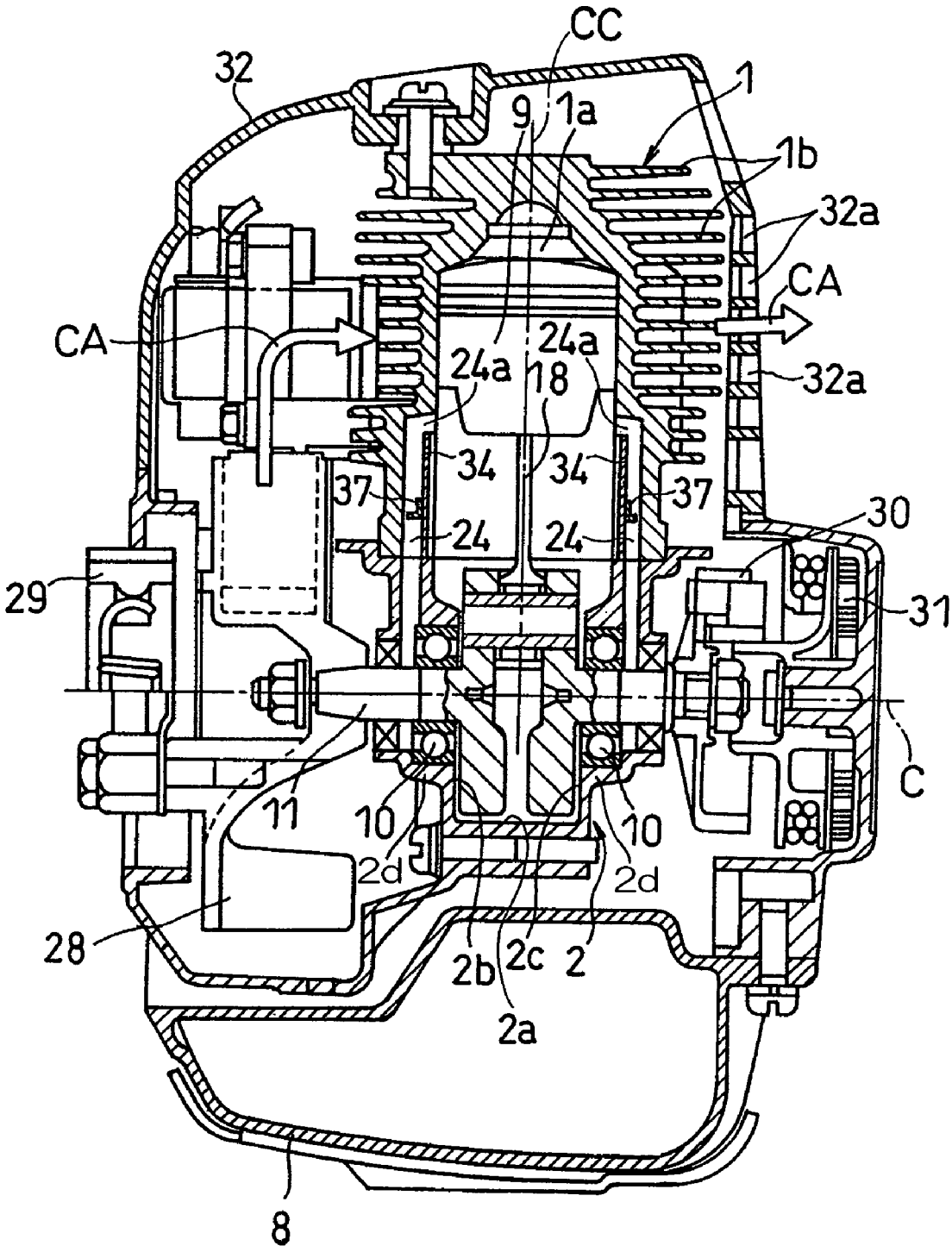
FIG. 2 is a longitudinal cross-sectional view taken along the line II-II in FIG. 1.

Hereinafter, a preferred embodiment of the present invention will be described in detail with reference to the accompanying drawings. In particular, FIG. 1 is a traverse cross-sectional view of a two cycle combustion engine according to a preferred embodiment of the present invention and FIG. 2 is a longitudinal cross-sectional view taken along the line II-II in FIG. 1. This embodiment is described by way of a two cycle combustion engine, particularly a two-cycle internal combustion engine utilizable in a brush cutter.

Referring to FIG. 1, the two cycle combustion engine shown therein includes a cylinder block 1 having a combustion chamber 1*a* defined therein, and a crankcase 2 having a crank chamber 2*a* defined therein, in which the cylinder block 1 is connected with an upper portion of the crankcase 2. Each of the cylinder block 1 and the crankcase 2 is made of a metallic material such as, for example, aluminum by means of any known metal molding technique using a die assembly. A carburetor 3 and an air cleaner unit 4, both forming a part of a fuel intake system, is secured to a first side wall portion, for example, a left side wall portion as viewed in FIG. 1, of the cylinder block 1 through an thermal insulator block 20 fixedly interposed between the cylinder block 1 and the carburetor 3 for insulating a heat transmission from the cylinder block 1 to the carburetor 3. On the other hand, a muffler 7 forming a part of an engine exhaust system is secured to a second, i.e., right side wall portion of the cylinder block 1 opposite to the first side wall portion thereof. A fuel tank 8 is secured to a bottom portion of the crankcase 2.

The cylinder block 1 has a multiplicity of spaced cooling fins 1*b* formed integrally therewith so as to protrude outwardly while extending around the cylinder block 1, and is formed with a cylinder bore 1A defined therein. A reciprocating piston 9 is accommodated therein for movement up and down in a direction axially of the cylinder bore 1A.

As best shown in FIG. 2, the crankcase 2 has front and rear end walls 2*b* and 2*c* each formed with a respective bearing housing identified generally by 2*d* and accommodating therein a corresponding crankshaft bearing 10. A crankshaft 11 having front and rear ends opposite to each other operatively extends within the crankcase 2 with the front and rear ends supported rotatably by the crankshaft bearings 10. As best shown in FIG. 1, a portion of the crankshaft 11 offset laterally from the crank axis C (FIG. 2), about which the crankshaft 11 rotates, is provided with a hollow crank pin 12. This hollow crank pin 12 and a hollow piston pin 13 provided in and carried by the piston 9 are drivingly connected together through a connecting rod 18. Specifically, the connecting rod 18 has a big end, carrying a big end bearing 14, and a small end carrying a small end bearing 17 opposite to the big end bearing 14, and the big end bearing 14 is rotatably connected with the hollow crank pin 12 while the small end bearing 17 is rotatably connected with the hollow piston pin 13. The crankshaft 11 is provided with crank webs 19 on respective sides of the crank pin 12. An ignition plug P is mounted atop the cylinder block 1.

The thermal insulator block 20 has an air supply passage 21 and an air/fuel mixture supply passage 22 defined therein so as to extend parallel to each other and communicated with the cylinder block 1 through the first side wall portion of the cylinder block 1, with the air supply passage 21 positioned above the air/fuel mixture supply passage 22. A peripheral wall of the cylinder block 1 defining the cylinder bore 1A is formed with a downstream passage portion of the air/fuel mixture supply passage 22, which has an air/fuel mixture supply port 22*a* open into the cylinder bore 1A, and an exhaust passage 23 defined therein and having an exhaust port 23*a* open into the cylinder bore 1A so as to communicate with the combustion chamber 1*a* so that exhaust gases (burned gases) can be exhausted to the outside through this exhaust passage 23 by way of the muffler 7.

The illustrated combustion engine also includes first and second scavenging passages 24 and 27 for communicating between the combustion chamber 1*a* in the cylinder block 1 and the crank chamber 2*a* in the crankcase 2 through the crankshaft bearings 10, with the second scavenging passage 27 positioned at a location closer to the exhaust port 23*a* than the first scavenging passage 24. Those first and second scavenging passages 24 and 27 have their respective downstream ends defining respective first and second scavenging ports 24*a* and 27*a* which are positioned at a level lower than the uppermost edge of the exhaust port 23*a*. The first and second scavenging passages 24 and 27 are closely juxtaposed relative to each other in a direction substantially circumferentially of the cylinder block 1.

As will become clear from the subsequent description, the first and second scavenging passages 24 and 27 referred to above are provided in two pairs, one pair positioned across the cylinder bore 1A.

The cylinder block 1 also has an air intake passage 52 defined therein for introducing an air from the air supply passage 21 in the thermal insulator block 20 into upper regions of the first and second scavenging passages 24 and 27. The air supply passage 21 in the thermal insulator block 20 has a downstream exit provided with a reed valve 54 operable to open the air supply passage 21 when the pressure inside the air intake passage 52 communicated therewith decreases down to a value lower than a predetermined pressure. It is to be noted that although the air intake passage 52 is, in the illustrated embodiment, communicated with both of the first and second scavenging passages 24 and 27, it may be communicated with only one of the first and second scavenging passages closer to the exhaust passage 23, that is, the second scavenging passage 27.

Referring now to FIG. 2, one end (or, a left end as viewed therein) of the crankshaft 11, which is rotatably supported within the crankcase 2 by means of the crankshaft bearings 10 has a cooling fan 28 mounted thereon for rotating together therewith, which fan 28 concurrently serves as a flywheel. The cooling fan 28 has a centrifugal clutch 29 fitted thereto for transmitting an output of the combustion engine to a drive transmission shaft (not shown) of the brush cutter. On the other hand, the opposite end (or, a right end as viewed therein) of the crankshaft 11 has a starter pulley 30 mounted thereon for rotation together therewith, and a recoil starter 31 for driving the crankshaft 11 through the starter pulley 30 is arranged at a location axially outwardly of the starter pulley 30.

A stream of cooling air CA induced by the cooling fan 28 during the rotation of the latter is utilized to cool the cylinder block 1, having been guided by a shroud 32, covering the cylinder block 1 and the muffler 7 (FIG. 1), so as to flow interspaces each defined between the neighboring cooling fins 1*b* and 1*b*. The stream of cooling air CA used to cool the cylinder block 1 in this manner is subsequently discharged to the outside through one or a plurality of vent holes 32*a* defined in the shroud 32.

Figure 3:
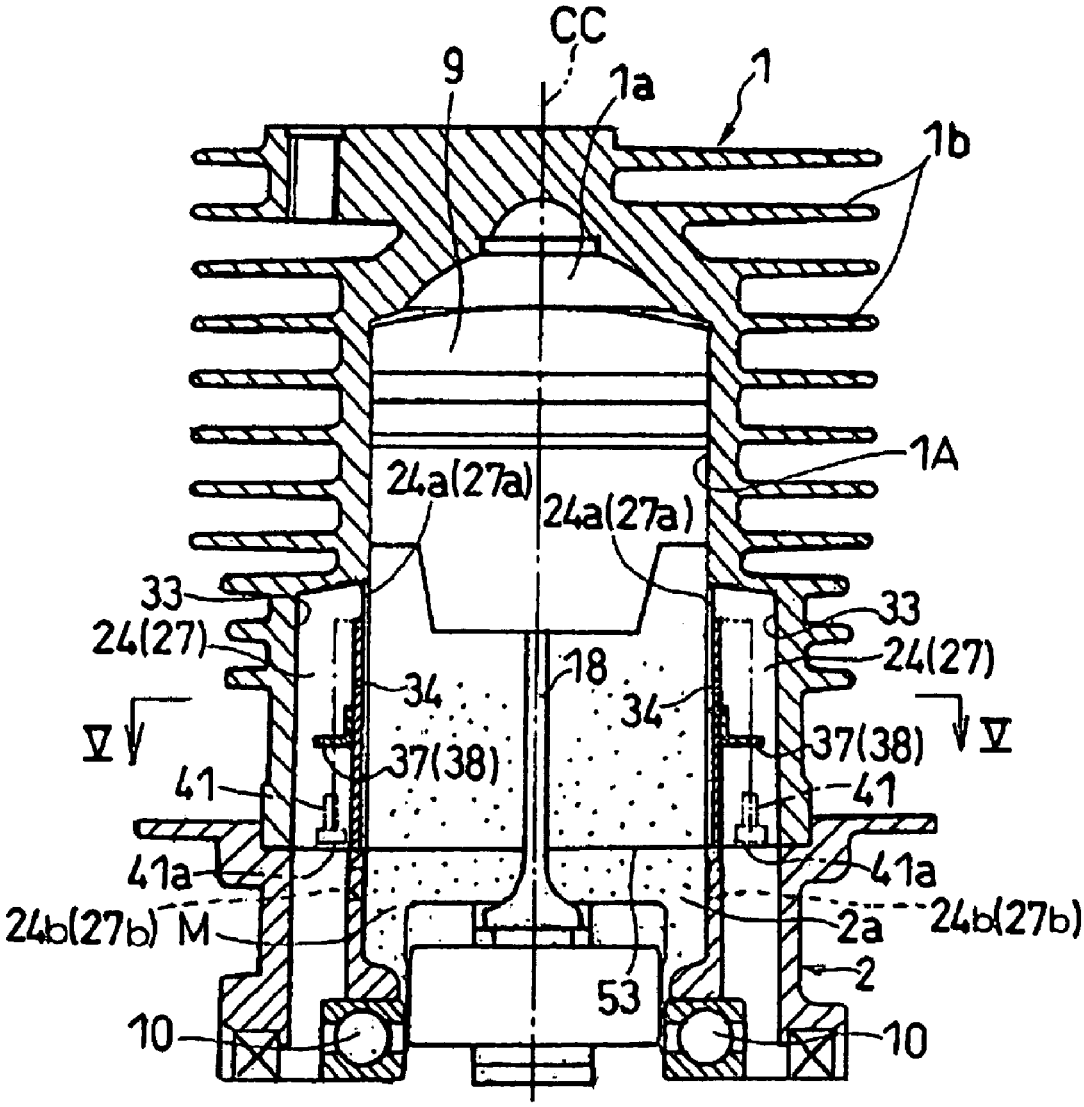
FIG. 3 is a longitudinal sectional view, on an enlarged scale, of a cylinder block employed in the two cycle combustion engine.
Figure 4:
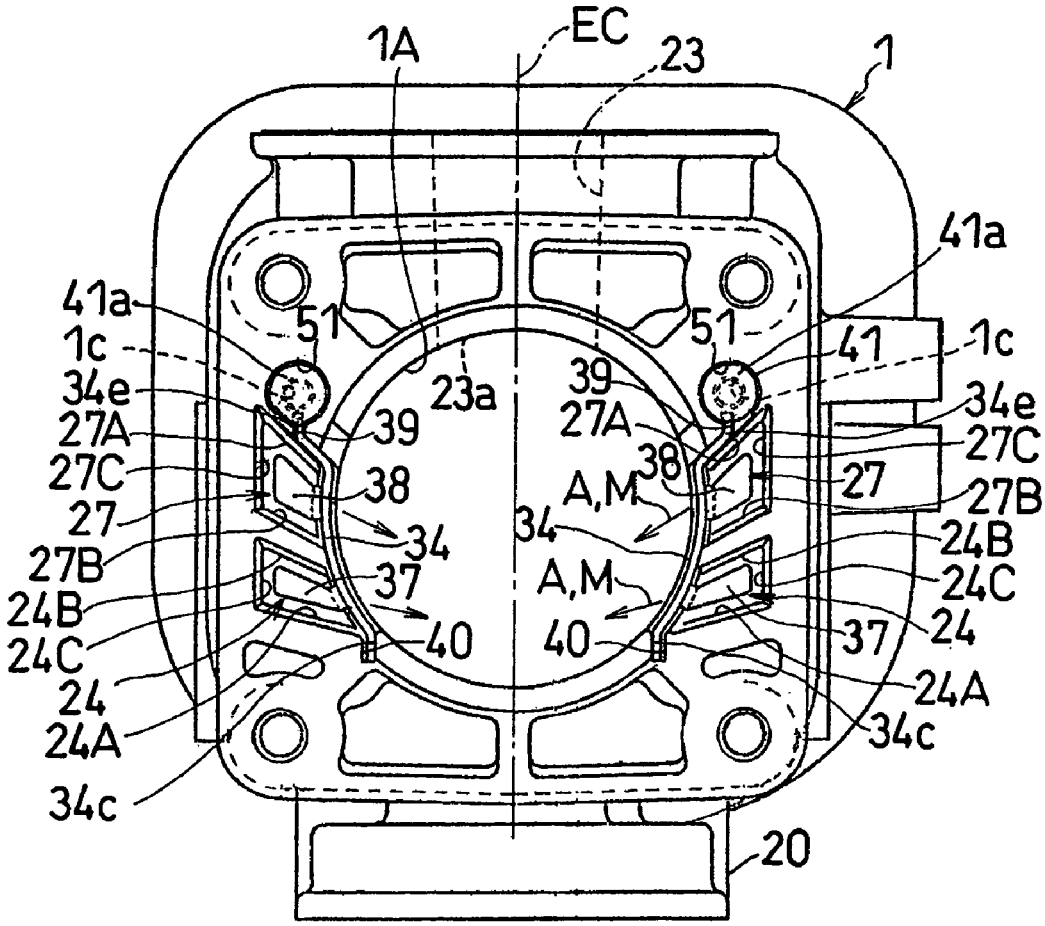
FIG. 4 is a bottom plan view of the cylinder block shown in FIG. 3.

FIG. 3 illustrates, on an enlarged scale, an essential portion of the cylinder block 1 shown in FIG. 2, and FIG. 4 is a bottom plan view of the cylinder block 1 shown in FIG. 3. As best shown in FIG. 4, each of the first and second scavenging passages 24 and 27 is formed in a pair, with each pair positioned on respective opposite sides of the cylinder block 1 with respect to the longitudinal axis EC of the exhaust passage 23. As best shown in FIG. 3, each of the first and second scavenging passages 24 and 27 of each pair includes a groove 33 defined in the cylinder block 1 by means of casting so as to extend in a vertical direction along the cylinder axis CC from a portion of the cylinder bore 1A generally intermediate of the height of the cylinder bore 1A down to a lower end thereof, and a scavenging-passage-defining wall member 34 covering an opening of the groove 33 open to the cylinder bore 1A, but excluding an upper end portion of the groove 33. It is to be noted that the scavenging-passage-defining wall member 34 referred to above is a member formed separate from the cylinder block 1.

Thus, it will readily be seen that each of the first and second scavenging passages 24 and 27 is partitioned from the cylinder bore 1A with the scavenging-passage-defining wall member 34 and is communicated with the cylinder bore 1A through the respective first or second scavenging port 24*a* or 27*a* left above the scavenging-passage-defining wall member 34.

Figure 6:
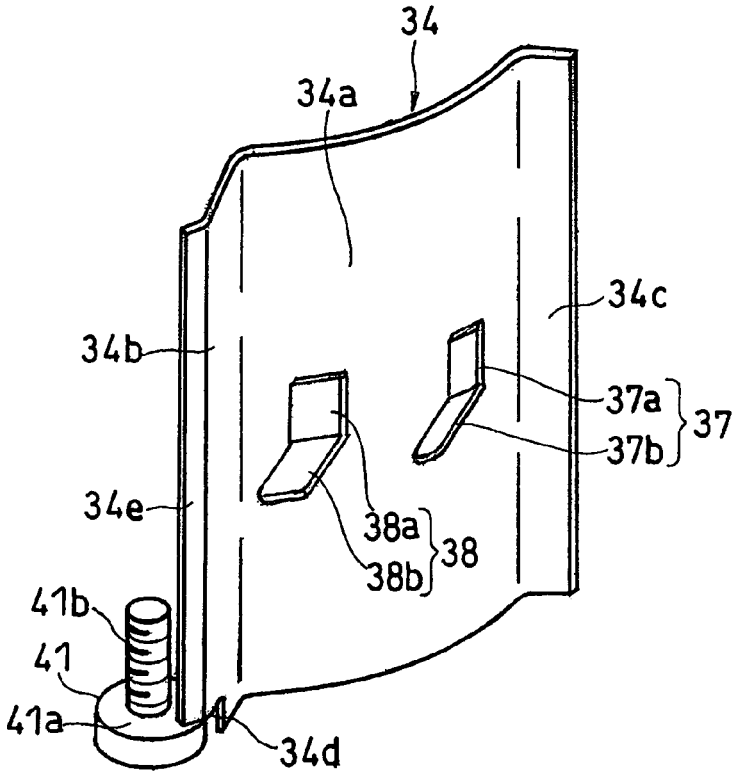
FIG. 6 is a schematic perspective view showing one of scavenging-passage-defining wall members and an associated retaining member.

As best shown in FIG. 6, the scavenging-passage-defining wall member 34 for each scavenging passages 24 and 27 is made of a metallic plate and includes a partitioning wall portion 34*a* forming a part of the peripheral surface of the cylinder bore 1A and so curved as to occupy a portion of the cylindrical shape of the cylinder bore 1A, mounting lug portions 34*b* and 34*c* protruding laterally outwardly from opposite side edges of the partitioning wall portion 34*a* and radially outwardly with respect to the cylinder bore 1A, and an engagement portion 34*e* protruding further outwardly from one of the mounting lug portions, that is, the mounting lug portion 34*b*. Lower areas of the mounting lug portion 34*b* and the engagement portion 34*e* are cut out to cooperatively define a cutout 34*d*. The partitioning wall portion 34*a* of the respective scavenging-passage-defining wall member 34 has an outer curved surface having first and second scavenge regulating segments 37 and 48 welded thereto. Each of those first and second scavenge regulating segments 37 and 38 is bent to represent a substantially L-shaped configuration and made up of a fixture piece 37*a* or 38*a*, welded to the outer curved surface of the partitioning wall portion 34*a*, and a protruding piece 37*b* or 38*b* protruding from the associated fixture piece 37*a* or 38*a* in a direction substantially perpendicular to the partitioning wall portion 34*a*.

Figure 5:
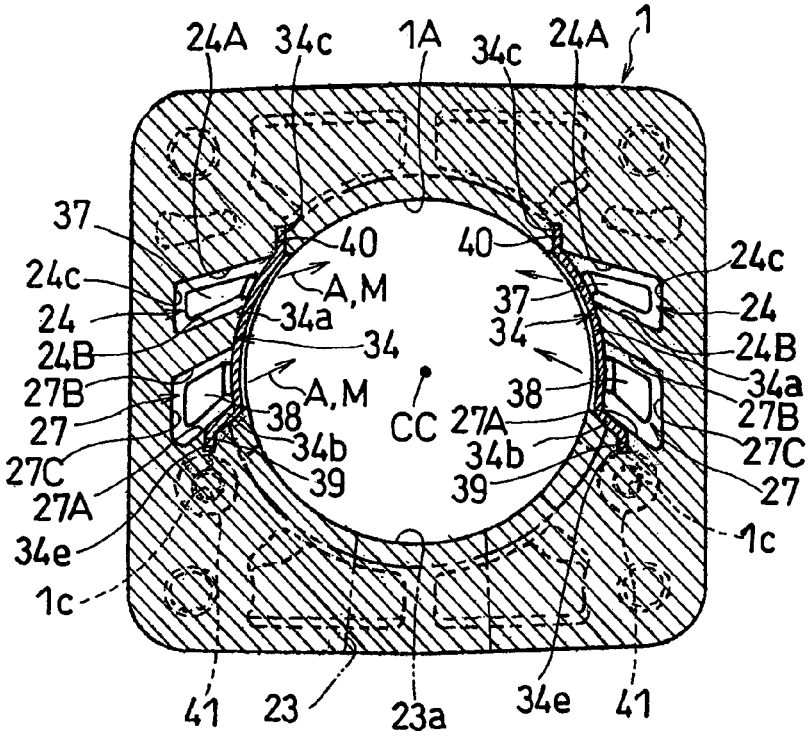
FIG. 5 is a cross-sectional view taken along the line V-V in FIG. 3, showing the cylinder block on a somewhat enlarged scale.

As shown in FIG. 5 showing, on an enlarged scale, the cross-section taken along the line V-V in FIG. 3, the cylinder block 1 is formed with engagement grooves 39 and 40 employed for each of the scavenging-passage-defining wall member 34 or each set of the closely juxtaposed first and second scavenging passages 24 and 27. The engagement grooves 39 and 40 for each scavenging-passage-defining wall member 34 extend vertically in parallel relation with the cylinder axis CC and are positioned spaced a distance from each other in a direction circumferentially of the cylinder bore 1A for receiving the engagement portion 34*e* and the mounting lug portion 34*c* of the respective scavenging-passage-defining wall member 34. Those engagement grooves 39 and 40 open downwardly of the cylinder block 1 as best shown in FIG. 4 showing the bottom plan view of the cylinder block 1. Accordingly, when each of the scavenging-passage-defining wall member 34 is mounted in the cylinder block 1 with the engagement portion 34*e* and the mounting lug portion 34*c* thereof slidingly inserted from below in the respective engagement grooves 39 and 40, the partition wall portion 34*a* forms respective parts of inner diametric walls of the first and second scavenging passages 24 and 27 of each pair.

In view of the foregoing, the first and second scavenging passages 24 and 27 of each pair are partitioned from the cylinder bore 1A by the presence of the single or common partitioning wall portions 34*a* of the scavenging-passage-defining wall members 34 and are therefore communicated with the cylinder bore 1A only through the first and second scavenging ports 24*a* and 27*a* shown in FIG. 3. In this condition, the scavenge regulating segments 37 and 38 in each of the partitioning wall portions 34*a* are positioned at respective locations substantially intermediate of the length of the respective scavenging passages 24 or 27 with respect to the vertical direction.

As shown in FIG. 4, with the engagement portion 34*e* and the mounting lug portion 34*c* of each scavenging-passage-defining wall member 34 engaged in the respective engagement grooves 39 and 40 in the manner described above, the respective scavenging-passage-defining wall member 34 is fixedly held in position by means of a corresponding retaining member 41 in the form of, for example, a bolt. Specifically, each of the retaining members 41 is firmly threaded from below into a respective internally threaded hole 1*c* defined in a bottom end face of the cylinder block 1, with a head 41*a* of the retaining member 41 engaged in the cutout 34*d* shown in FIG. 6 so as to prevent the associated scavenging-passage-defining wall member 34 from detaching from the cylinder block 1. The bottom end face of the cylinder block 1 shown in FIG. 4 is formed with recesses 51, each for receiving the associated head 41*a* so that a free end face of the head 41*a* of the retaining member 41 remote from an externally threaded shank 4*b* (FIG. 6) thereof is positioned on one side of a plane of connection 53 (FIG. 3) between the cylinder block 1 and the crankcase 2 adjacent the cylinder block 1.

The plane of connection 53 referred to above is defined by respective mating surfaces of the cylinder block 1 and the crankcase 2, that is, the bottom end face of the cylinder block 1 and an upper face of the crankcase, with which the bottom end face of the cylinder block 1 is connected. The plane of connection 53 is, in this embodiment, perpendicular to the cylinder axis CC.

As shown in FIG. 5, each of the scavenging-passage-defining wall members 34 is fitted to the cylinder block 1 in the manner described hereinabove to define the corresponding set of the first and second scavenging passages 24 and 27 in cooperation with the cylinder block 1. With this arrangement the first scavenge regulating segment 37 is separated a distance from two inner side surfaces 24A and 24B of the first scavenging passage 24, which confront with each other in a circumferential direction of the cylinder bore 1A, and an outer diametric surface 24*c* of the same first scavenging passage 24, and is so positioned as to occupy a circumferential center portion of an inner-diametric-wall side of the first scavenging passage 24. Similarly, the second scavenge regulating segment 38 is separated a distance from two inner side surfaces 27A and 27B of the second scavenging passage 27, which confront with each other in a circumferential direction of the cylinder bore 1A, and an outer diametric surface 27*c* of the second scavenging passage 27 and is so positioned as to occupy a circumferential center portion of an inner-diametric-wall side of the second scavenging passage 27.

Hereinafter, the operation of the two cycle combustion engine of the structure hereinbefore described will be described.

Figure 7:
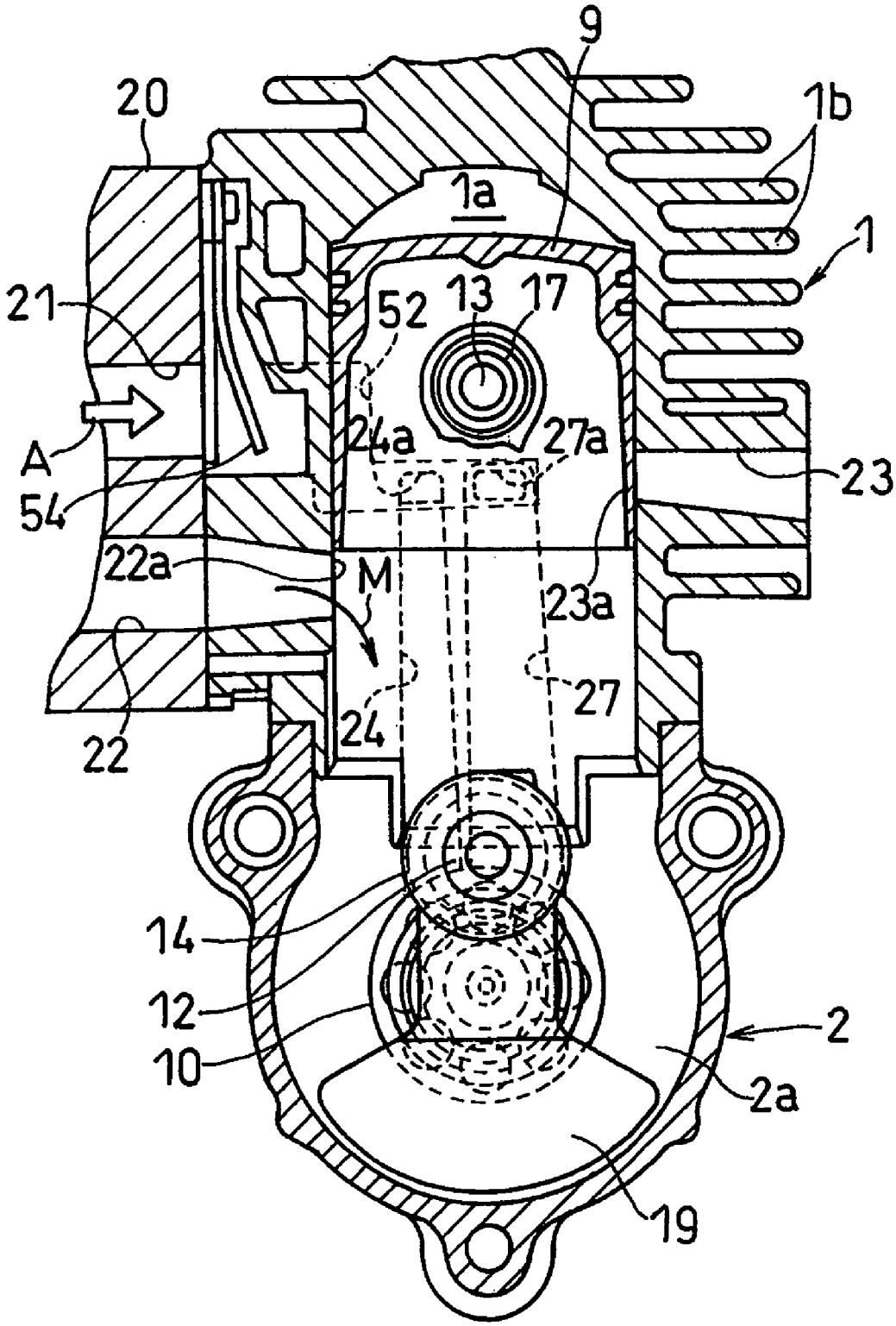
FIG. 7 is a traverse cross-sectional view of the two cycle combustion engine in FIG. 1, showing the cylinder block and a crankcase that are conditioned during an intake stroke.

During the intake stroke of the two cycle combustion engine as shown in FIG. 7, an air/fuel mixture M can be directly introduced into the crank chamber 2*a* through air/fuel mixture supply port 22*a*, open at the inner peripheral surface of the cylinder block 1, when a negative pressure is developed within the cylinder block 1 and the crank chamber 2*a* as the reciprocating piston 9 within the cylinder block 1 approaches the top dead center position. The air/fuel mixture M so introduced is partly used to lubricate the big end bearing 14 and the small end bearing 17 for the connecting rod 18. Since at this time a negative pressure is also developed inside the first and second scavenging passages 24 and 27 of each pair, which are communicated with the crank chamber 2*a* through the crankshaft bearings 10, the air intake passage 52, which are communicated with the first and second scavenging passages 24 and 27, is also held under a negative pressure enough to allow the read valve 54, fitted to the exit port of the air supply passage 21 in the thermal insulator block 20, allowing the air A to be introduced from the air supply passage 21 temporarily into the first and second sc avenging passages 24 and 27 through the air intake passage 52. In this way, as long as the reed valve 54 is opened during the intake stroke by the effect of the negative pressure inside the crank chamber 2*a*, the air A is introduced at all times into the first and second scavenging passages 24 and 27 and, therefore, a sufficient amount of air required to prevent a blow-off can be secured in respective upper regions of the first and second sc avenging passages 24 and 27 of each pair.

Figure 8:
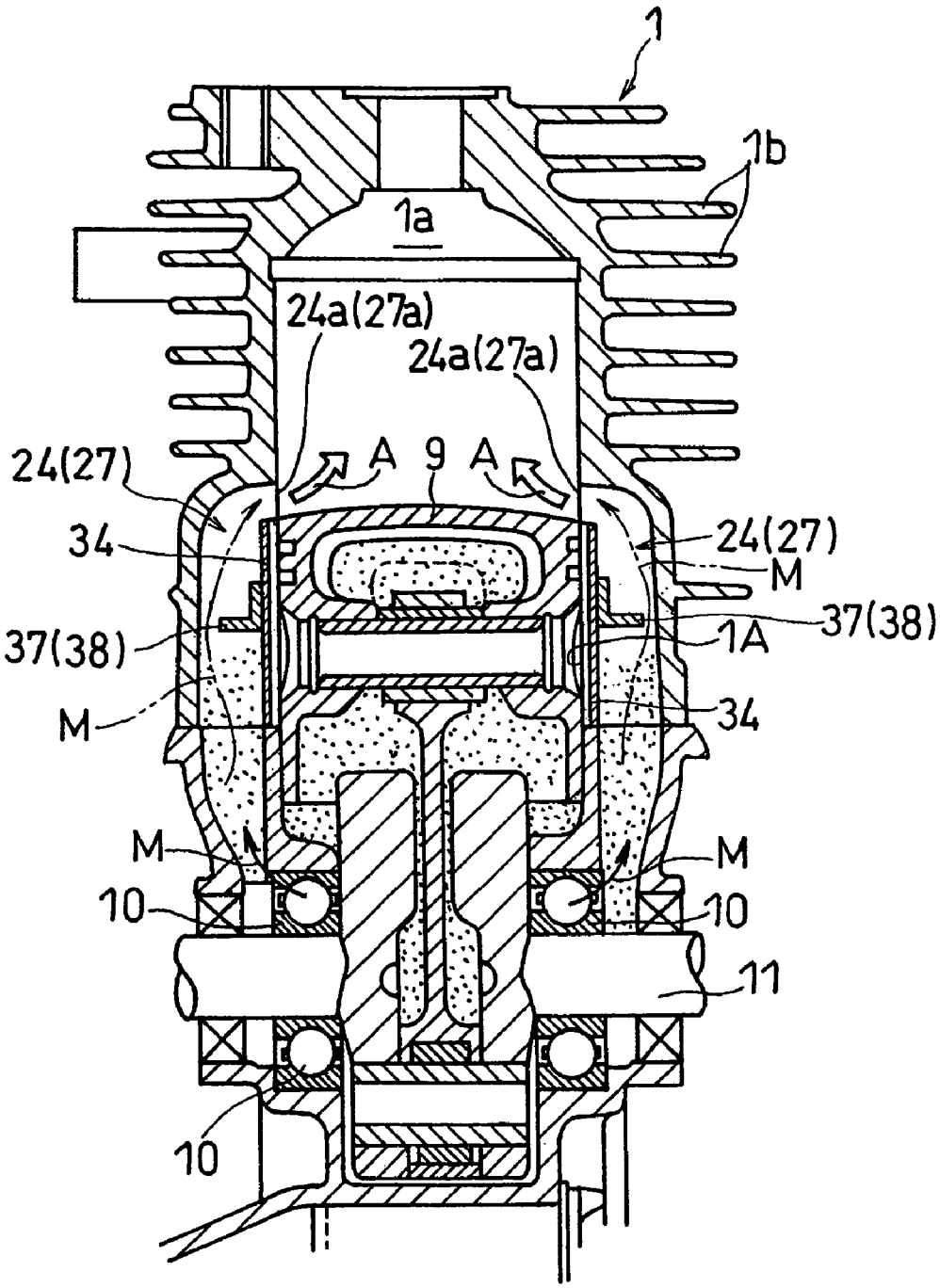
FIG. 8 is a longitudinal cross-sectional view of the two cycle combustion engine in FIG. 1, showing the cylinder block and the crankcase that are conditioned during a scavenging stroke.

During the subsequent scavenging stroke, the air/fuel mixture M and the air A are introduced into the combustion chamber 11*a* through the associated first and second scavenging ports 24*a* and 27*a* of the first and second scavenging passages 24 and 27, respectively. At this time, the air A is first introduced into the combustion chamber 11*a* from the first and second scavenging ports 24*a* and 27*a* as shown in FIG. 8, followed by introduction of the air/fuel mixture M into the combustion chamber 11*a*, and, therefore, by the action of the first introduced air A, the blow-off of the air/fuel mixture M from the exhaust port 23*a* (shown in FIG. 1) can be avoided. At the time the air/fuel mixture M is introduced into the combustion chamber 1*a* through the first and second scavenging passages 24 and 27, the air/fuel mixture M within the crank chamber 2*a* flows into the first and second scavenging passages 24 and 27 through the gaps between the inner and outer races of the crankshaft bearings 10 and, therefore, the crankshaft bearings 10 can be lubricated with fuel and oil contained in the air/fuel mixture M.

Also, during the scavenging stroke, the flow of the air/fuel mixture M is regulated by the scavenge regulating segments 37 and 38 within the scavenging passages 24 and 27 so that the air/fuel mixture M can flow in regions bound by the opposite side and outer diametric surfaces 24A, 24B, 27A, 27B, 24C and 27C of the respective scavenging passages 24 and 27 before it is injected into the cylinder bore 1A through the scavenging ports 24*a* and 27*a* (shown in FIG. 3).

It is to be noted that the scavenge regulating segments 37 and 38 positioned inside the respective scavenging passages 24 and 27 regulate the flow of the air/fuel mixture with the cross-sectional areas of those scavenging passages 24 and 27 reduced locally. As a result, not only can the air/fuel mixture M flowing the scavenging passages 24 and 27 past the associated scavenge regulating segments 37 and 38 flow at a high velocity, but also the flow of the air/fuel mixture M concentrates in respective regions of the scavenging passages 24 and 27 adjacent the outer diametric surfaces 24C and 27C and the inner side surfaces 24A, 24B, 27A and 27B. Consequently, by the effect of the air/fuel mixture flowing at such high velocity, an undesirable deposit of fuel, contained in the air/fuel mixture M, on the outer diametric surfaces 24C, 27C, and the inner side surfaces 24A, 24B, 27A, and 27B of those scavenging passages 24 and 27 can be suppressed advantageously and, hence, reduction of the combustion efficiency, which would otherwise result from introduction of the fuel into the combustion chamber 1*a* in the form of fuel droplets, can be avoided effectively.

The air/fuel mixture is, after having flowed past the inner side surfaces 24A and 24B, 27A and 27B of the first and second scavenging passages 24 and 27, respectively, injected into the combustion chamber 1*a* through the scavenging ports 24*a* and 27*a* (shown in FIG. 3) straightforwardly in a direction along the surfaces 24A and 24B, 27A and 27B. Accordingly, the blow-off of the air/fuel mixture through the exhaust port 23*a* can be effectively avoided by properly setting such direction along the surfaces 24A, 24B, 27A and 27B to a direction departing from the exhaust port 23*a*.

Furthermore, since the scavenging-passage-defining wall members 34, which are members separate from the cylinder block 1 and are fitted to the cylinder block 1, is employed, the die assembly used to form the cylinder block 1 may be of a simple structure including no slide die and, therefore, the cost of manufacture can be reduced. Also, since the scavenging-passage-defining wall members 34 are members separate from the cylinder block 1 as described above, the scavenge regulating segments 37 and 38 can be easily provided in the associated scavenging-passage-defining wall members 34, resulting in suppression of increase of the manufacturing cost. Yet, since the scavenging-passage-defining wall members 34 and the scavenge regulating segments 37 and 38 are made of a metallic plate, the scavenging-passage-defining wall members 34 and the scavenge regulating segments 37 and 38 themselves can be advantageously manufactured inexpensively.

Yet, since the scavenging-passage-defining wall members 34 are, as shown in FIG. 4, supported with the opposite portions 34*c* and 34*e* thereof slid into the engagement grooves 39 and 40 defined in the cylinder block 1 so as to open at their lower ends downwardly of the cylinder block 1 and are retained in position in contact with the heads 41*a* of the retaining members 41 secured to the cylinder block 1, they will not depart from the engagement grooves 39 and 40. Accordingly, there is no possibility that when the cylinder block 1 itself is moved or transported from one place to another, the scavenging-passage-defining wall members 34 may drop out from the cylinder block 1 and, therefore, the assemblability of the two cycle combustion engine embodying the present invention can be increased.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. For example, one or both of the lower ends of the first and second scavenging passages 24 and 27 shown in FIG. 3 may not extend down to the associated crankshaft bearings 10, but may be communicated with the crank chamber 2*a* through lower open ends 24*b* and 27*b*, shown by the dotted lines in FIG. 3, at a location above the crankshaft bearings 10 so that the air/fuel mixture M within the crank chamber 2*a* can be introduced directly into the scavenging passages 24 and 27 without passing through the crankshaft bearings 10.

Accordingly, such changes and modifications are, unless they depart from the scope of the present invention as delivered from the claims annexed hereto, to be construed as included therein.

What is claimed is:

1. A two cycle combustion engine which comprises:

a cylinder block having a cylinder bore defined therein;

a scavenging-passage-defining wall member made separate from the cylinder block and fitted to the cylinder block to form an inner diametric wall of a scavenging passage;

wherein the scavenging-passage-defining wall member is provided with a scavenge regulating segment spaced from an outer diametric surface of the scavenging passage and two opposed side surface of the scavenging passage that are opposed to each other in a direction circumferentially of the cylinder bore, the scavenge regulating segment occupying a circumferential center portion of an inner-diametric-wall side of the scavenging passage.

2. The two cycle combustion engine as claimed in claim 1, wherein each of the scavenging-passage-defining wall member and the scavenge regulating segment is made of a plate member.

3. The two cycle combustion engine as claimed in claim 2, wherein the scavenge regulating segment is secured to the scavenging-passage-defining wall member by welding.

4. The two cycle combustion engine as claimed in claim 1, further comprising a retaining member fitted to the cylinder block and wherein the cylinder block is formed with engagement grooves open axially downwardly of the cylinder block and wherein the scavenging-passage-defining wall member is inserted at its opposite side portions within the respective engagement grooves and is retained in position by the retaining member so that the scavenging-passage-defining wall member is not detached from the engagement grooves.

5. The two cycle combustion engine as claimed in claim 1, wherein a plurality of the scavenging passages are closely juxtaposed to each other in a direction circumferentially of the cylinder block and wherein a plurality of the scavenge regulating segments are provided for the single scavenging passage defining wall and positioned one by one inside each of the scavenging passages.

* * * * *